US012398922B2

(12) United States Patent
Deivasigamani et al.

(10) Patent No.: US 12,398,922 B2
(45) Date of Patent: Aug. 26, 2025

(54) HEATING SYSTEM

(71) Applicant: Intellihot, Inc., Galesburg, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 404 days.

(21) Appl. No.: 18/081,655

(22) Filed: Dec. 14, 2022

(65) Prior Publication Data

US 2024/0200827 A1 Jun. 20, 2024

(51) Int. Cl.

| | |
|---|---|
| ***F24H 4/02*** | (2022.01) |
| ***F24D 3/02*** | (2006.01) |
| ***F24D 3/18*** | (2006.01) |
| ***F24D 13/04*** | (2006.01) |
| ***F24D 17/02*** | (2006.01) |
| ***F24D 19/08*** | (2006.01) |
| ***F24H 1/10*** | (2022.01) |
| ***F24H 9/12*** | (2022.01) |
| ***F24H 9/20*** | (2022.01) |

(52) U.S. Cl.

CPC ..... *F24H 4/02* (2013.01); *F24D 3/02* (2013.01); *F24D 3/18* (2013.01); *F24D 13/04* (2013.01); *F24D 17/02* (2013.01); *F24D 19/083* (2013.01); *F24H 1/101* (2013.01); *F24H 9/2028* (2013.01); *F24H 9/12* (2013.01)

(58) Field of Classification Search

CPC ..... F24H 4/02; F24H 1/101; F24H 9/2028; F24H 9/12; F24D 3/02; F24D 3/18; F24D 13/04; F24D 17/02; F24D 19/083

See application file for complete search history.

(56) References Cited

U.S. PATENT DOCUMENTS

2020/0224927 A1* 7/2020 Chaudhry ..... F24H 15/443
2023/0243545 A1* 8/2023 Garrabrant ..... F24D 5/00 165/286

FOREIGN PATENT DOCUMENTS

AU 2016253669 A1 * 5/2017
GB 2088549 A * 6/1982 ..... F24D 19/1009
WO WO-2016071978 A1 * 5/2016 ..... F24D 11/0214

OTHER PUBLICATIONS

Navien, Npe A2 Advanced (Year: 2021).*
WO-2016071978-A1 translation (Year: 2016).*

* cited by examiner

*Primary Examiner* — Steven S Anderson, II
*Assistant Examiner* — Kurt J Wolford
(74) *Attorney, Agent, or Firm* — Jong Patent Firm; Cheng Ning Jong; Tracy P. Jong

(57) ABSTRACT

A heating system including a trunk line including a first half and a second half; an inlet fluid conductor and an outlet fluid conductor, wherein the inlet fluid conductor connected to an inlet end of the trunk line and the outlet fluid conductor connected to an outlet end of the trunk line; at least one heating subsystem, each of the at least one heating subsystem including a fluid path for heating a working fluid disposed therein, a first end of the fluid path connected to the first half and a second end of the fluid path connected to the second half; a primary pump interposed in the inlet fluid conductor, the pump configured to push the working fluid through the at least one heating subsystem and the trunk line; a bleed valve disposed at a downstream end of the first half.

4 Claims, 2 Drawing Sheets

HEATING SYSTEM

BACKGROUND OF THE INVENTION

1. The Field of the Invention

The present invention relates to an electric tankless heating system. More specifically, the present invention is directed to an electric tankless heating system having equipment suitable for aiding filling of its working fluid.

2. Background Art

In water heating systems, the potential for *Legionella* is more pronounced in a tank system or a large fluid conductor, e.g., in a tank water heater, etc., due to the low velocity of the contents of the tank water heater and the contents that are disposed in a suitable temperature range for *Legionella* proliferation. Although one or more temperature sensors may be used for providing feedback to the heating of the contents of the tank water heater to achieve a setpoint temperature, the effect of stratification can cause layers of fluid having different temperatures. Therefore, although portions of the contents of a water heater may be disposed at a setpoint temperature that is unfavorable for *Legionella* proliferation, there potentially exists other portions that may be disposed at temperatures suitable for *Legionella* proliferation. Further, in a tank heating system, potable water is drawn from a large reservoir of heated water to meet a hot water demand, increasing the risk of *Legionella* proliferation as the opportunity for a tank heating system to harbor *Legionella* is significantly higher than a tankless heating system where hot potable water is prepared just-in-time.

Scaling and corrosion are longstanding problems encountered in the water heating industry which limit the life span of equipment. Although many corrosion and scale inhibitors are known and used in high temperature application, many of these systems have limitations and do not provide the type of protection to allow significant extension of equipment life span. Conventional water heaters cannot store potable water at a very high temp due to the potential for scaling and hence corrosion.

Solar heating systems or heaters have become increasingly popular solutions either as a supplemental heating system or as a sole heating system whether or not municipal electricity is available. Where thermal batteries and swing tanks are involved and are made to function in conjunction with solar heaters, the overall heating solutions are often complicated to set up, involving set up procedures which are not only challenging for trained professionals to set up but also difficult for a user to detect a problem or the root cause of a problem if they malfunction during use. Further, these systems are often not easily scalable as there is very little reuse in the way of common subsystems being sourced as modules that can be added or removed.

Thus, there is a need in the heating art for a system that can be installed and set up on site without significant skills and knowledge on the part of the technician. This ensures the system is set up correctly on site without having to set up at factory, prior to delivery, which can incur significant additional shipping costs due to additional shipping weights caused mainly by working fluids in the system. Further, there exists a need in the heating art for a system configured for aiding its own setup and a system that is also useful for aiding in adopting equipment changes or additions. Further, there exists a need in the heating art for a system that is scalable and a system having subsystems that contribute to meet the overall heating demand in an efficient manner, i.e., according to the respective conditions of the subsystems at the time hot water is demanded.

SUMMARY OF THE INVENTION

In accordance with the present invention, there is provided a heating system including:

(a) a trunk line including a first half and a second half;

(b) an inlet fluid conductor and an outlet fluid conductor, wherein the inlet fluid conductor is configured to be connected to an inlet end of the trunk line and the outlet fluid conductor is configured to be connected to an outlet end of the trunk line;

(c) at least one heating subsystem, each of the at least one heating subsystem including a fluid path for heating a working fluid disposed therein, a first end of the fluid path is configured to be connected to the first half and a second end of the fluid path is configured to be connected to the second half;

(d) a primary pump interposed in the inlet fluid conductor, the pump configured to push the working fluid through the at least one heating subsystem and the trunk line;

(e) a bleed valve disposed at a downstream end of the first half, wherein the bleed valve is disposed at a level higher than the at least one heating subsystem and the pump; and (f) a secondary valve disposed downstream from the bleed valve on the trunk line, wherein the secondary valve is configured to be closed, the pump is configured to draw the working fluid through the inlet fluid conductor to fill the fluid path and the first half and urge air through the bleed valve before the secondary valve is opened to allow the working fluid to fill the second half and exit through the outlet fluid conductor.

In one embodiment, the heating system further includes a secondary pump disposed on the fluid path. In one embodiment, the working fluid is glycol. In one embodiment, the at least one heating subsystem is a heat pump. In one embodiment, the secondary valve is a motorized valve.

An object of the present invention is to provide a heating system having equipment suitable for aiding filling of its working fluid by reducing the number of steps required on the part of a technician while setting up the heating system.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—heating system
4—inlet fluid conductor
6—outlet fluid conductor
8—pump
10—bleed valve
12—secondary valve
14—pump
16—heat pump unit
18—first half of trunk line
20—second half of trunk line
22—trunk line
24—heating system
26—thermal battery
28—working fluid
30—pump
32—pump
34—spent fluid outlet
36—heated fluid inlet
38—pump
40—heat transfer coil
42—inlet fluid conductor
44—outlet fluid conductor
46—check valve
48—fill valve
50—solar heater

PARTICULAR ADVANTAGES OF THE INVENTION

The present heating system is uncomplicated in its setup and does not require significant training and knowledge on the part of a technician in getting the system set up. This ensures the system is set up correctly on site without having to set up at factory which can incur significant additional shipping costs due to additional shipping weights caused mainly by working fluids in the system. The present heating system is configured to facilitate its own setup during installation or to facilitate its own setup upon adopting changes made to the system, e.g., due to the additions of heating subsystems, making the heating system easily scalable. Further, the heating system includes heating subsystems which cooperate to contribute to meet the overall heating demand in an efficient manner, i.e., according to the respective conditions of the subsystems at the time hot water is demanded.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
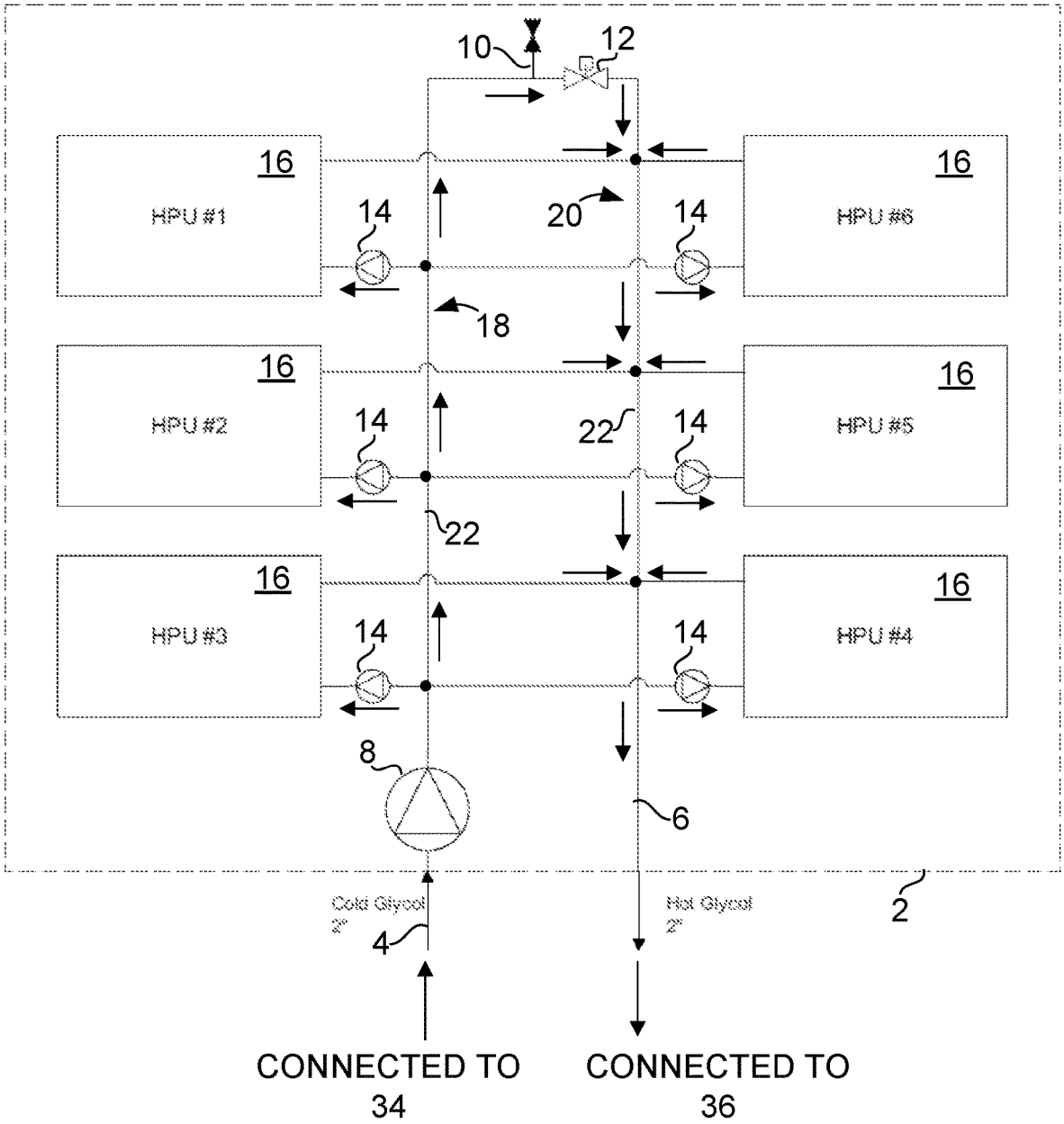
FIG. 1 is a diagram depicting an electric tankless heating system.

FIG. 1 is a diagram depicting an electric tankless heating system 2. The heating system 2 includes a trunk line 22, an inlet fluid conductor 4, an outlet fluid conductor 6, a bleed valve 10 disposed at a downstream end of the first half of the trunk line 22 and a plurality of heating subsystems, e.g., heat pump units 16. The trunk line 22 includes a first half 18 and a second half 20. The inlet fluid conductor 4 is configured to be connected to an inlet end of the trunk line 22 and the outlet fluid conductor 6 is configured to be connected to an outlet end of the trunk line 22. Although six heat pump units 16 are shown, the heating system 2 needs only at least one heat pump unit 16 to function. However, with more than one heat pump unit 16, if only one unit 16 is required at a particular moment, a unit 16 already disposed in a condition most favorable to harness the required thermal energy will be used, e.g., a unit that has already been operating for an extended amount of time as this unit will be able to achieve the required heating most efficiently. To add heating capacity, more heat pump units 16 can be added, making the heating system 2 capable of supplying an increased heating capacity to a system connected to the inlet fluid conductor 4 and the outlet fluid conductor 6. Each of the heat pump units 16 may also be replaced with other types of heaters as long as these heaters can also cause the working fluid, e.g., glycol, flowing through each fluid path of each heater to harness the required thermal energy. A first end of the fluid path is configured to be connected to the first half 18 of the trunk line 22 and a second end of the fluid path is configured to be connected to the second half 20 of the trunk line 22. Therefore, for each heater, the working fluid enters the trunk line 22 via the first half of the trunk line 22 and returns from the trunk line 22 via the second half of the trunk line 22. A primary pump 8 is provided for mobilizing a working fluid through the heating system, i.e., the trunk line 22 and the individual heating subsystems 16, from inlet fluid conductor 4 to the outlet fluid conductor 6. The first half of a trunk line is defined essentially as the portion of the trunk line 22 from which a fluid path of a heating subsystem or heater branches and the second half is defined essentially as the portion of the trunk line 22 into which a fluid path of a heating subsystem merges. While the primary pump 8 is capable of causing a flow to the heating system via the trunk line 22, pushing a flow through the fluid path of each of the heating subsystems especially when most, if not all of them are required to be turned on, requires additional motive power which cannot be provided by the pump 8 alone. In one embodiment, the heating system 2 further includes a secondary pump 14 coupled with each of the fluid paths.

The bleed valve 10 is disposed at a level higher than the heating subsystems 16 and the pump 14. In the embodiment shown, the heating system 2 further includes a secondary valve 12 disposed downstream from the bleed valve 10 on the trunk line 22. In order to ensure, during installation, that the air in the trunk line 22 and fluid paths are properly vented, the secondary valve 12 is first closed while the pump 4 is turned on to draw a working fluid from another heating system, e.g., a thermal battery or a network of thermal batteries through the inlet fluid conductor 4. Once the trunk line 22 and fluid paths of the heating subsystems 16 have been sufficiently filled with working fluid, the displaced and now pressurized air escapes the bleed valve 10 and the air previously disposed in the second half of the trunk line 22 and the fluid paths of the heating subsystems 16 is then pushed out of the heating system 2 through the outlet fluid conductor 6. When a continuous activation of the bleed valve has ceased, the first half of the trunk line 22 is considered to have been filled with the working fluid. The secondary valve 12 is then opened to allow the working fluid from the first half 18 of the trunk line 22 to fill the second half 20 and exit through the outlet fluid conductor 6, pushing with it any remaining air pockets out of the outlet fluid conductor 6. In one embodiment, the secondary valve 12 is a motorized valve, allowing the filling process of the heating system to be automated, e.g., upon the detection of a cessation in a continuous actuation of the bleed valve 10. The heating system 2 shown in FIG. 1 may be connected to a heat sink shown in FIG. 2.

Figure 2:
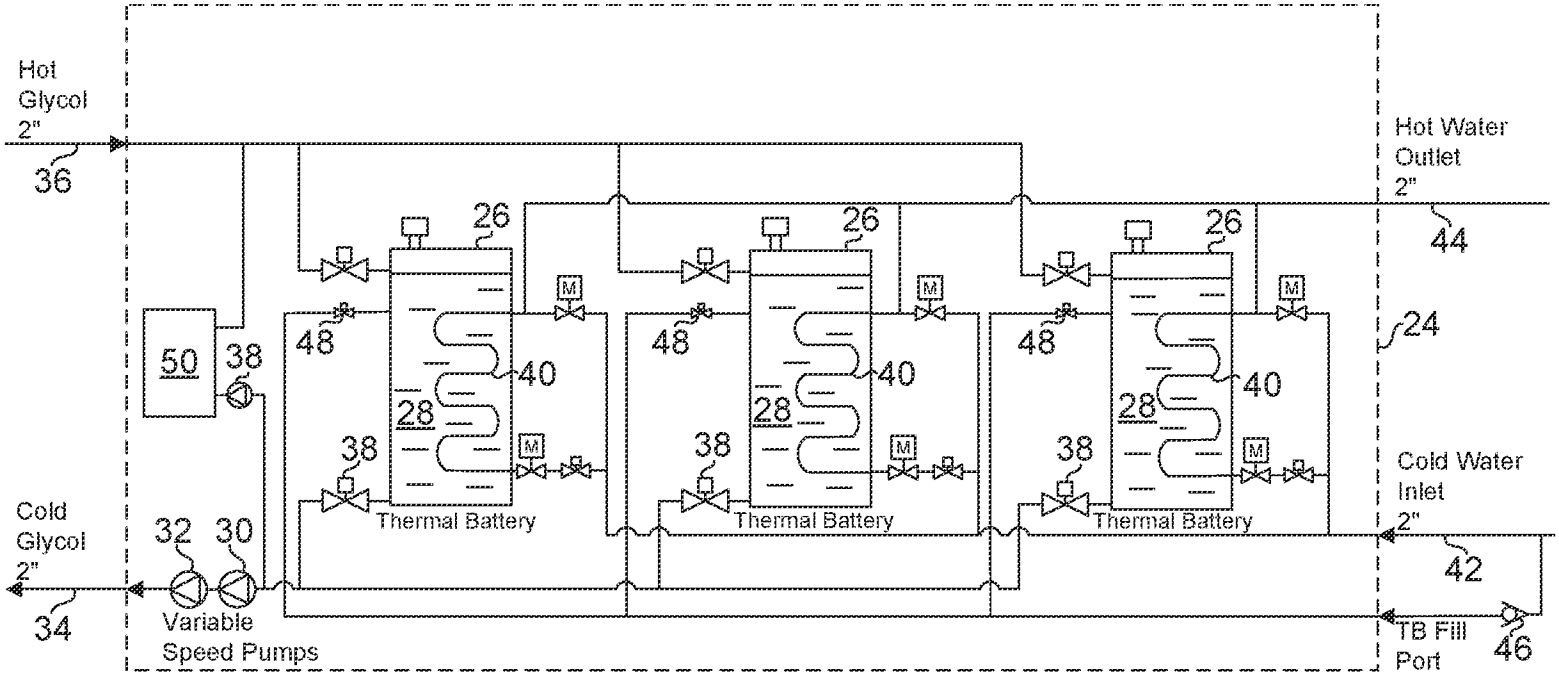
FIG. 2 is a diagram depicting a heating system suitable for receiving the heating system shown in FIG. 1 as a heat source.

FIG. 2 is a diagram depicting a heating system 24 suitable for receiving the heating system 2 shown in FIG. 1 as a heat source. Here, heating system 24 can be viewed as a heat sink and it is essentially a plurality of thermal batteries 26 configured to supply thermal energy to a water flow received at an inlet fluid conductor 42 and exits at an outlet fluid conductor 44 via heat transfer coils 40. In the embodiment shown, the heating system 24 further includes two pumps 30, 32 to draw a working fluid, e.g., glycol, through the spent fluid conductor 34 out of thermal batteries 26 having their respective valves 38 open and into heating system 2 shown in FIG. 1 via inlet fluid conductor 4. The return flow of the working fluid 28 exits the outlet fluid conductor 6 shown in FIG. 1 and enters the heated fluid conductor 36 shown in FIG. 2. In one embodiment, at least one of the pumps 30, 32 is a variable speed pump. In controlling the flow through the pumps 30, 32, the speed of a pump may be modulated to provide an optimal combined flowrate of the working fluid 28 to a heat exchanger connected to a heat source before returning to the thermal batteries 26. During normal operations, a required flowrate may be met with only one pump turned on. However, in one mode, both are configured to turn on at an appropriate speed to result in the required flowrate. Referring back to FIG. 1, the inlet fluid conductor 4 and the outlet fluid conductor 6 can also be connected to a solar heater 50 that can assist in thermal charging the contents of the thermal batteries 26 with the aid of a pump 38. The thermal batteries 26 are connected in parallel to be filled during installation with the filling of each thermal battery 26 controlled by a fill valve 48. The fill valve-equipped lines are further connected to a check valve 46 which allows flows into the thermal batteries while the fill valves remain open while preventing exit of the fluid in the fill fluid conductors into the cold water inlet 42. As the check valve 46 is connected to a potable water source, this eliminates the possibility that the potable water can be contaminated by a back flow of the working fluid, e.g., glycol into the potable water flow in the inlet fluid conductor 42.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A heating system comprising:

(a) a trunk line comprising a first half and a second half;

(b) an inlet fluid conductor and an outlet fluid conductor, wherein said inlet fluid conductor is configured to be connected to an inlet end of said trunk line and said outlet fluid conductor is configured to be connected to an outlet end of said trunk line;

(c) at least one heating subsystem, each said at least one heating subsystem comprising a fluid path for heating a working fluid disposed therein, a first end of said fluid path is configured to be connected to said first half and a second end of said fluid path is configured to be connected to said second half;

(d) a primary pump interposed in said inlet fluid conductor, said pump configured to push the working fluid through said at least one heating subsystem and said trunk line;

(e) a bleed valve disposed at a downstream end of said first half, wherein said bleed valve is disposed at a level higher than said at least one heating subsystem and said pump;

(f) a motorized valve disposed downstream from said bleed valve on said trunk line; and (g) a control mechanism configured to close said motorized valve, turn on said pump to draw the working fluid through said inlet fluid conductor to fill the first end of each fluid path and said first half and urge air through said bleed valve and upon detection of the cessation of a continuous actuation of said bleed valve, open said motorized valve to allow the working fluid to fill said second half and exit through said outlet fluid conductor.

2. The heating system of claim 1, further comprising a secondary pump disposed on said fluid path.

3. The heating system of claim 1, wherein the working fluid is glycol.

4. The heating system of claim 1, wherein at least one of said at least one heating subsystem is a heat pump.

* * * * *